US011957253B2

(12) United States Patent
Liu

(10) Patent No.: US 11,957,253 B2
(45) Date of Patent: Apr. 16, 2024

(54) ROCKING CHAIR FOR CHILDREN

(71) Applicant: ZHONGSHAN CITY TONGYIN BABY CO., LTD., Guangdong (CN)

(72) Inventor: Weibing Liu, Guangdong (CN)

(73) Assignee: ZHONGSHAN CITY TONGYIN BABY CO., LTD., Zhongshan (CN)

( * ) Notice: Subject to any disclaimer, the term of this patent is extended or adjusted under 35 U.S.C. 154(b) by 160 days.

(21) Appl. No.: 17/719,396

(22) Filed: Apr. 13, 2022

(65) Prior Publication Data

US 2022/0232997 A1 Jul. 28, 2022

Related U.S. Application Data

(63) Continuation of application No. PCT/CN2021/080922, filed on Mar. 16, 2021.

(30) Foreign Application Priority Data

Mar. 19, 2020 (CN) ..... 202010197938.2

(51) Int. Cl.
*A47D 13/10* (2006.01)
*A47C 3/025* (2006.01)
*A47D 9/02* (2006.01)

(52) U.S. Cl.
CPC ..... *A47D 13/105* (2013.01); *A47C 3/0251* (2018.08); *A47D 9/057* (2022.08)

(58) Field of Classification Search
CPC ..... A47C 3/0251; A47D 9/057; A47D 13/105
See application file for complete search history.

(56) References Cited

U.S. PATENT DOCUMENTS 6,068,566 A * 5/2000 Kim ..... A47D 9/057 474/84
6,574,806 B1 * 6/2003 Maher ..... A47D 9/057 297/260.2

(Continued)

FOREIGN PATENT DOCUMENTS

CN 101773344 A 7/2010
CN 201624403 U 11/2010

(Continued)

OTHER PUBLICATIONS

International Search Report of PCT Patent Application No. PCT/CN2021/080922 dated Jun. 7, 2021.

*Primary Examiner* — Philip F Gabler

(57) ABSTRACT

A rocking chair for children, comprising a seat body, a supporting frame and a seat body limiting mechanism, a driving motor, a driving motor power output part and a rotating shaft; one end of the rotating shaft is fixedly connected to the driving motor power output part, and the seat body pivots around the other end of the rotating shaft; when the rotating shaft rotates, the pivot point between the other end of the rotating shaft and the seat body moves relative to a fixed connection point between one end of the rotating shaft and the driving motor power output part at a certain distance; and the seat body limiting mechanism can limit the included angle between the seat body and the rotating shaft to be kept within a set angle when the driving motor drives the rotating shaft for forward and reverse rotation in a reciprocating mode.

16 Claims, 14 Drawing Sheets

(56) References Cited

U.S. PATENT DOCUMENTS

| | | | | |
|---|---|---|---|---|
| 8,967,716 | B2 * | 3/2015 | Mountz | A47C 9/02 297/256.16 |
| 9,743,779 | B2 * | 8/2017 | Zhao | A47D 9/057 |
| 10,702,073 | B2 * | 7/2020 | Paperno | G05D 3/10 |
| 2005/0264063 | A1 * | 12/2005 | Babcock | A47D 13/02 297/250.1 |
| 2005/0283908 | A1 * | 12/2005 | Wong | A47D 9/057 5/105 |
| 2023/0124305 | A1 * | 4/2023 | Li | A47D 13/105 297/273 |

FOREIGN PATENT DOCUMENTS

| | | | |
|---|---|---|---|
| CN | 112021870 | A | 12/2020 |
| CN | 112089265 | A | 12/2020 |
| CN | 112450651 | A | 3/2021 |

* cited by examiner

ROCKING CHAIR FOR CHILDREN

CROSS REFERENCE TO RELATED APPLICATIONS

The present application is a Continuation Application of PCT Application No. PCT/CN2021/080922 filed on Mar. 16, 2021, which claims the benefit of Chinese Patent Application No. 202010197938.2 filed on Mar. 19, 2020. All the above are hereby incorporated by reference in their entirety.

FIELD OF THE INVENTION

The invention relates to a rocking chair for children.

BACKGROUND OF THE INVENTION

For families with infants and young children, in order to take care of children and have time to work or do housework, the parents have the urgent need to place their children on rocking chairs for children which are low in cost and large in swing range and can swing, especially place their children on rocking chairs for children which are low in cost and large in swing range and have various swing modes. A rocking chair with a seat and a rotating shaft fixed is available in the market, the seat rotates along with the rotating shaft, but children are easy to feel dizzy and uncomfortable. A rocking chair with two Z-shaped rotating shafts is available in the market, a seat body and the two rotating shafts are movably connected and the seat body swings in a distance relative to a supporting frame. However, the problems that the movement range is not large, the technological requirements of a seat body supporting seat, the shafts and a supporting frame are very high when the seat body rotates along with the two shafts, the cost is high, and only a single swing mode can be carried out due to the fact that the two shafts rotate exist. At present, a rocking chair for children which is large in swing range, low in cost and single in swing mode is needed in the market, and a rocking chair for children which is large in swing range and low in cost and can achieve two different swing modes at the same time is also needed.

SUMMARY OF INVENTION

The invention aims to provide a rocking chair for children, which is large in swing range, low in cost and capable of realizing one swing mode, and also provide a rocking chair for children, which is large in swing range, low in cost, and capable of realizing two swing modes at the same time.

The invention is realized through the following technical solution:

A rocking chair for children includes a seat body, a supporting frame and a seat body limiting mechanism, the supporting frame includes a driving mechanism, the driving mechanism includes a driving motor, a driving motor power output part and a rotating shaft, the seat body is used for carrying a child, there is only one rotating shaft providing a sole support for the seat body, one end of the rotating shaft pivots at the supporting frame and is fixedly connected with the driving power output part, the other end of the rotating shaft pivots at the seat body, and a vertical line from ground to a pivot point between the rotating shaft and the supporting frame deviates from a vertical line from the ground to a pivot point between the rotating shaft and the seat body; the seat body limiting mechanism includes a limiting piece and a limiting matching piece matched with the limiting piece, the limiting piece is movably connected with the limiting matching piece, when the rotating shaft rotates, the rotating shaft is rotated relative to the seat body, and the seat body limiting mechanism limits the included angle between the seat body and the rotating shaft to be kept at pre-set angles.

As further optimization of the technology, the limiting piece and the limiting matching piece are movably connected in a relative distance moving mode, and when the rotating shaft rotates, the limiting piece and the limiting matching piece move relatively at a certain distance so as to limit the included angle between the seat body and the rotating shaft to be kept at pre-set angles.

As further optimization of the technology, the limiting piece is connected with the seat body, and the limiting matching piece is arranged on the supporting frame.

As further optimization of the technology, a vertical line from the ground to a connecting point between the limiting piece and the seat body deviates from a vertical line from the ground to a pivot point between the other end of the rotating shaft and the seat body.

As further optimization of the technology, the supporting frame includes a base and a mounting box, the mounting box is connected with the base, the limiting piece is a moving piece, the limiting matching piece is a moving groove, when the rotating shaft rotates, the moving piece moves relative to the moving groove. The moving piece is arranged on the seat body, the moving groove matched with the moving piece is formed in the mounting box, and when the rotating shaft rotates, the limiting piece moves relative to the limiting matching piece at a certain distance along with the seat body.

As further optimization of the technology, a rotating piece is arranged on the moving piece, the rotating piece is able to rotate around the moving piece, and the rotating piece is in surface fit with the moving groove.

According to a preferred implementation mode, a motion track line of the moving piece moving from a starting point to an end point of the moving groove is an arc; a vertical line connecting a highest point of the arc with a line connecting two end points of the arc is shorter than a vertical line connecting a highest point of another arc, formed by a rotating shaft swinging from a starting point to an end point, with a line connecting two end points of the arc mentioned in latter, and the moving groove is an arc-shaped groove.

As another implementation mode, a motion track line of the moving piece moving from a starting point to an end point of the moving groove is an arc; a vertical line connecting a highest point of the arc with a line connecting two end points of the arc is equal to a vertical line connecting a highest point of another arc, formed by a rotating shaft swinging from a starting point to an end point, with a line connecting two end points of the arc mentioned in latter, and the moving groove is an arc-shaped groove.

As another implementation mode, when the rotating shaft swings from the starting point to the end point, the motion track line formed when the moving piece moves from the starting point to the end point of the moving groove is a straight line, and the moving groove is a linear groove.

As further optimization of the technology, a matching point of the moving piece and the moving groove and the moving groove are distributed on one side of the rotating shaft.

As further optimization of the technology, a connecting line from a connecting point between the moving piece and the seat body to a pivot point between the seat body and the rotating shaft is perpendicular to a vertical line from the ground to the pivot point between the seat body and the rotating shaft; the connecting line from the connecting point between the moving piece and the seat body to the pivot point between the seat body and the rotating shaft is perpendicular to a connecting line from a matching point between the moving piece and the moving groove to the connecting point between the moving piece and the seat body.

As further optimization of the technology, when the seat body moves left and right, the moving groove is an inclined-plane groove, and the inclined-plane groove obliquely faces the rear direction of the seat body.

As further optimization of the technology, the moving groove is an arc-shaped groove or an irregular wavy groove with alternating heights, and the moving groove is roughly and symmetrically formed in the two sides of a projection line, on the mounting box, of the rotating shaft when the rotating shaft rotates to the highest position.

As further optimization of the technology, the moving groove is arranged close to a pivot point between the rotating shaft and the mounting box.

As further optimization of the technology, the driving mechanism further includes a sensor arranged on the driving motor and a reduction gear set connected to the driving motor, and the sensor is able to control the driving motor to continuously rotate forwards and backwards in a reciprocating mode so that the rotating shaft is able to continuously rotate forwards and backwards in a reciprocating mode, and the rotating shaft is obliquely arranged on the mounting box.

As further optimization of the technology, two rotating pieces are arranged on the moving piece, and two moving grooves correspondingly matched with the two rotating pieces are formed in the mounting box.

Compared with the prior art, the invention has the following advantages:

The seat body is independently supported by one rotating shaft, the seat body and the rotating shaft rotate flexibly, and the defects that interference is caused when the seat body is pivoted through two shafts, the requirement for technology is high, and the swing range is small are overcome. According to the rocking chair for children, the limiting piece and the limiting matching piece move relatively at a certain distance to limit the angle required by the seat body and the rotating shaft, so that different angles are set through the seat body and the rotating shaft when the rotating shaft rotates, one swing mode can be realized, and the rocking chair for children has the characteristics of large swing range, low cost, simple structure and stable seat body; the rocking chair for children can realize two different swing modes at the same time, and has the characteristics of large swing range, low cost, simple structure and stable seat body.

BRIEF DESCRIPTION OF THE DRAWINGS

In order to more clearly explain the technical solution of the embodiment of the invention, the following will be briefly introduced in combination with the accompanying drawings. It is obvious that the accompanying drawings in the following description are only the specific embodiments of the invention, and for those skilled in the field, on the premise that creative labor is not paid, other drawings can be obtained according to the drawings.

DETAILED DESCRIPTION OF ILLUSTRATED EMBODIMENTS

The embodiments of the invention are now described with reference to FIG. 1-FIG. 14.

Figure 1:
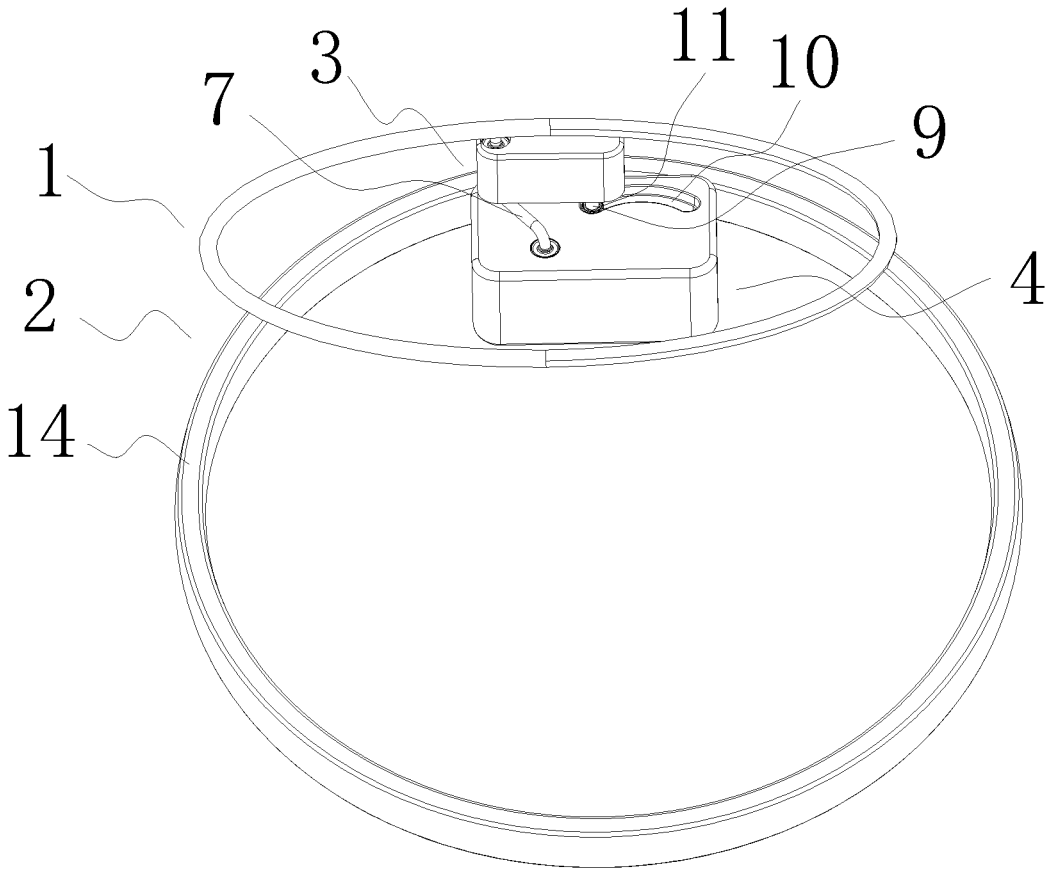
FIG. 1 is a structural schematic diagram of the rocking chair for children.

A children rocking chair as shown in FIG. 1 is characterized by including a seat body 1, a supporting frame 2 and a seat body limiting mechanism 3, the supporting frame 2 includes a driving mechanism 4, the driving mechanism 4 includes a driving motor 5, a driving motor power output part 6 and a rotating shaft 7, the seat body 1 is used for carrying a child, there is only one rotating shaft 7 providing a sole support for the seat body 1, one end of the rotating shaft 7 pivots at the supporting frame 2 and is fixedly connected with the driving power output part 6, the other end of the rotating shaft 7 pivots at the seat body 1, and a vertical line from ground to a pivot point between the rotating shaft 7 and the supporting frame 2 deviates from a vertical line from the ground to a pivot point between the rotating shaft 7 and the seat body 1; the seat body limiting mechanism 3 includes a limiting piece 9 and a limiting matching piece 10 matched with the limiting piece 9, the limiting piece 9 is movably connected with the limiting matching piece 10, when the rotating shaft 7 rotates, the rotating shaft 7 is rotated relative to the seat body 1, and the seat body limiting mechanism 3 limits the included angle between the seat body 1 and the rotating shaft 7 to be kept at pre-set angles.

Figure 11:
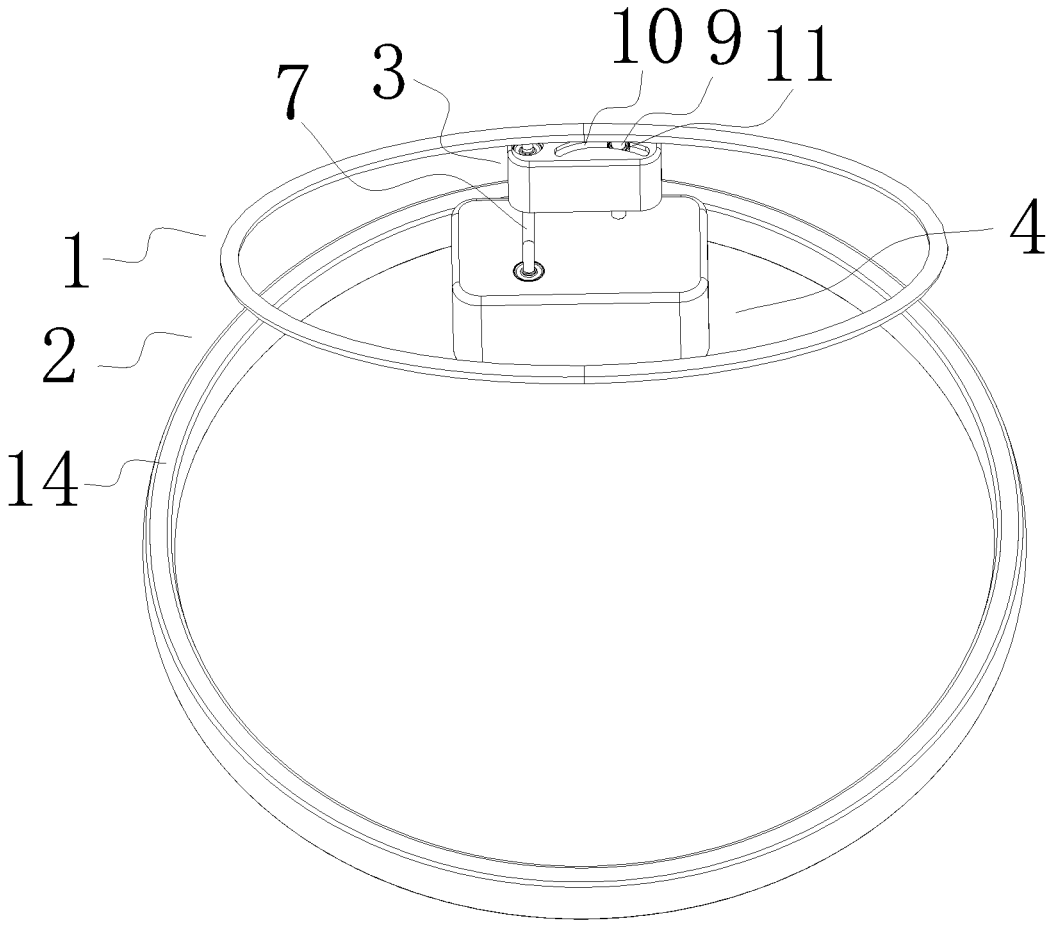
FIG. 11 is a structural schematic diagram of limited matching of the seat body of the rocking chair for children.
Figure 12:
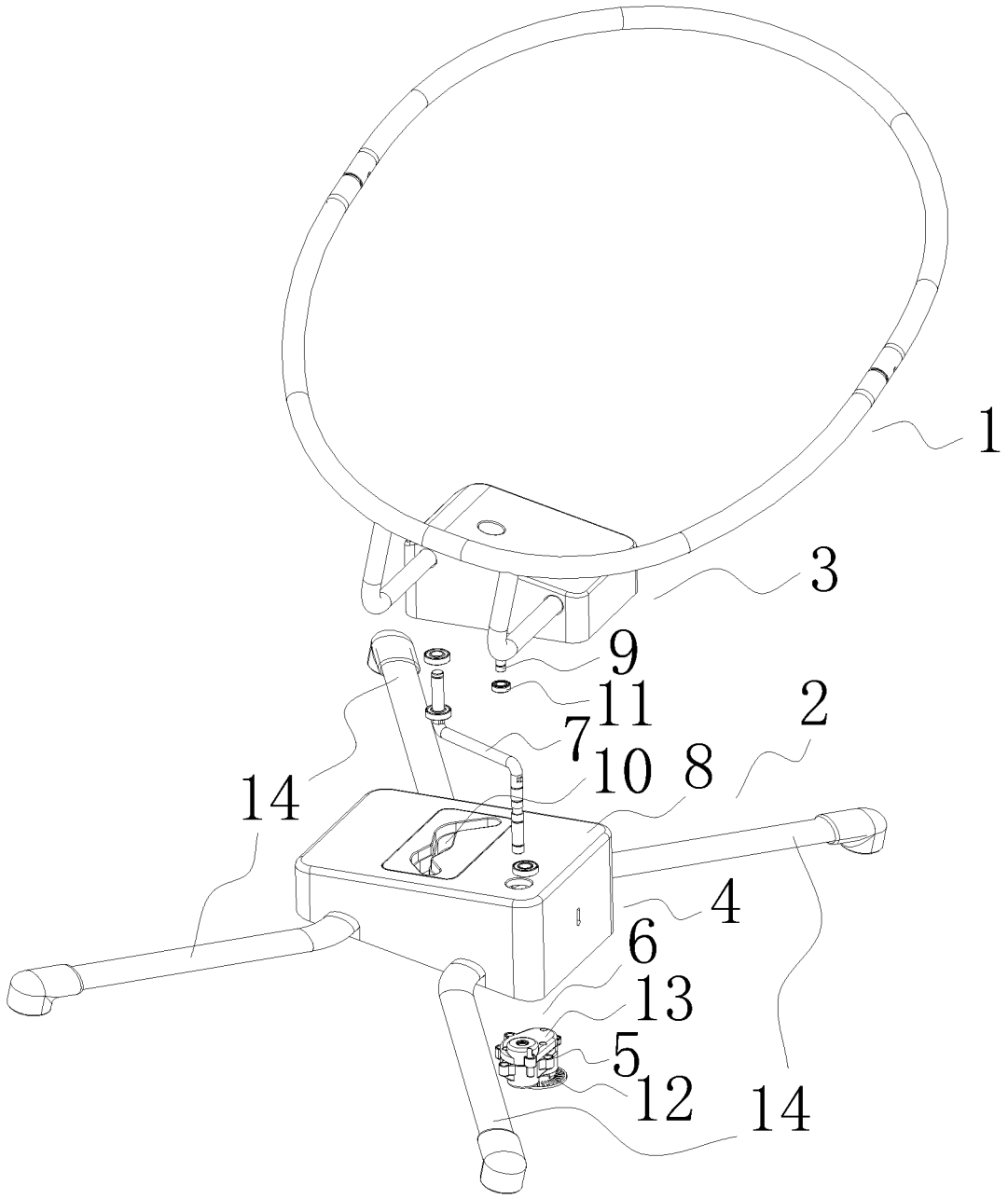
FIG. 12 is an explosion schematic diagram of the irregular wave-shaped moving groove structure of the rocking chair for children.

As shown in FIG. 1 and FIG. 11, the limiting piece 9 and the limiting matching piece 10 are movably connected in a relative distance moving mode, and when the rotating shaft 7 rotates, the limiting piece 9 and the limiting matching piece 10 move relatively at a certain distance so as to limit the included angle between the seat body 1 and the rotating shaft 7 to be kept at pre-set angles. The limiting piece 9 and the limiting matching piece 10 move at a certain distance, the limited angle is kept by the limiting piece 9 and the rotating shaft 7, the function is achieved more easily, and the structure is simpler.

As shown in FIG. 1, the limiting piece 9 is connected with the seat body 1, a vertical line from the ground to a connecting point between the limiting piece 9 and the seat body 1 deviates from a vertical line from the ground to a pivot point between the other end of the rotating shaft 7 and the seat body 1, and the limiting matching piece 10 is arranged on the supporting frame 2. The above is a preferred solution which has the advantage that when the rotating shaft 7 rotates, and the limiting piece 9 moves relative to the limiting matching piece 10 at a certain distance along with the seat body 1, the moving piece 9 on the seat body 1 always keeps a fixed distance with the pivot point of the rotating shaft 7 and the seat body 1 so as to prevent the seat body 1 from rotating around the rotating shaft 7, the connection between the limiting piece 9 and the seat body 1 deviates from a rotation axis to generate a force arm, and when the limiting piece 9 moves relative to the limiting matching piece 10 at a certain distance, it is more labor-saving to limit the angle set between the seat body 1 and the rotation shaft 7, so that the rotating shaft 7 swings more smoothly, and meanwhile, the force arm makes the seat body 1 more stable. The setting positions of the limiting piece 9 and the limiting matching piece 10 are different, as shown in the FIG. 12, the limiting piece 9 is arranged on the mounting box 8, and the limiting matching piece 10 is movably connected with the seat body 1, therefore, either case belongs to the protection scope of the invention.

As shown in FIG. 1, the supporting frame 2 includes a base 14 and a mounting box 8, the mounting box 8 is connected with the base 14, the limiting piece 9 is a moving piece 9, the limiting matching piece 10 is a moving groove 10, when the rotating shaft 7 rotates, the moving piece 9 moves relative to the moving groove 10, the moving piece 9 is limited through the moving groove 10, the structure is simple, and implementation is easy. The moving piece 9 is arranged on the seat body 1, the moving groove 10 matched with the moving piece 9 is formed in the mounting box 8, the moving piece 9 is connected with the seat body 1, and the structure is simple by arranging the moving groove 10 in the mounting box 8.

Figure 4:
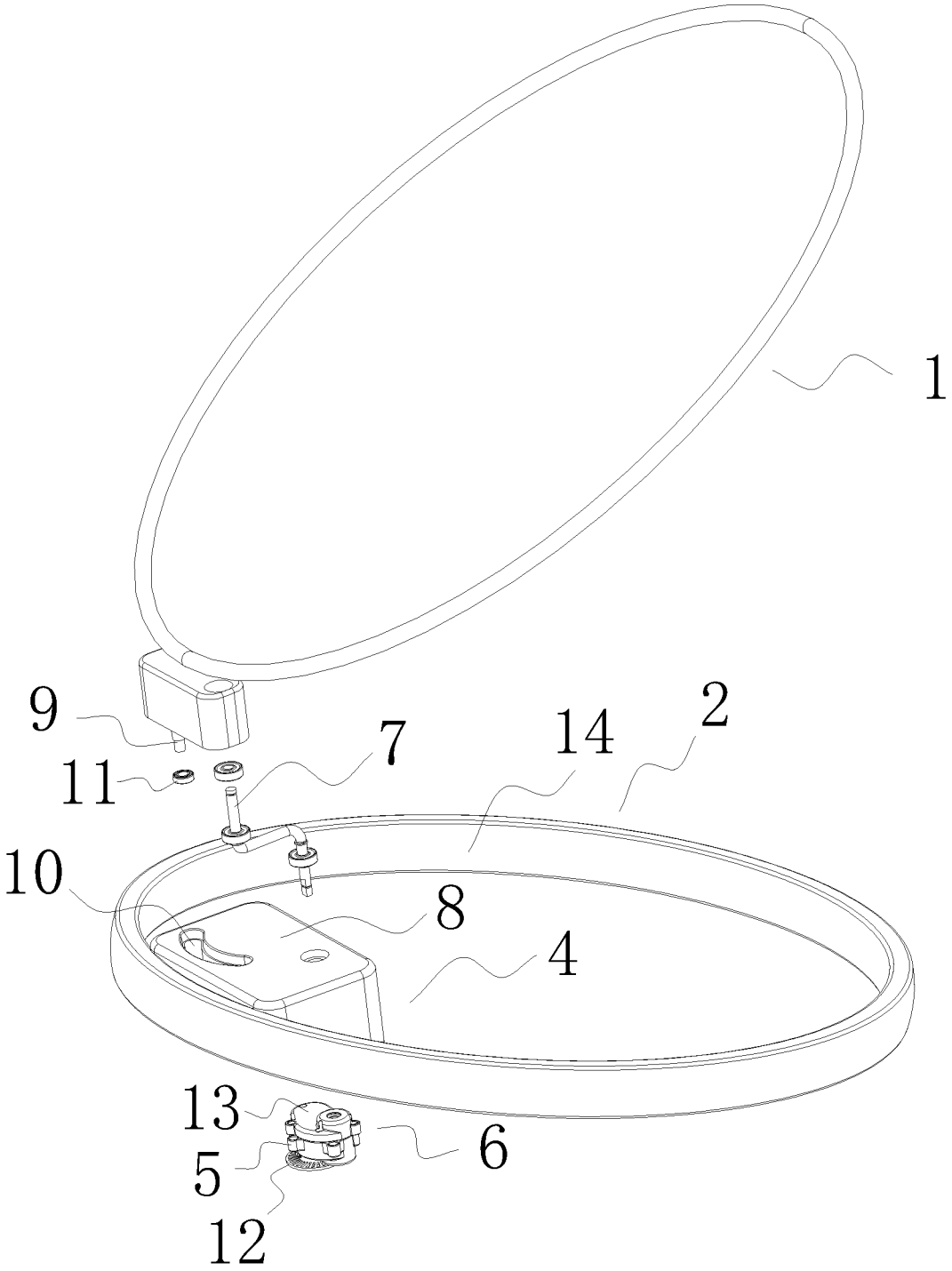
FIG. 4 is an explosion schematic diagram of the rocking chair for children.

As shown in FIG. 4, a rotating piece 11 is arranged on the moving piece 9, the rotating piece 11 can rotate around the moving piece 9, the rotating piece 11 is in surface fit with the moving groove 10, the rotating piece 11 is arranged on the moving groove 10 as to be in surface fit with the moving groove 10, the friction is reduced, the rocking chair for children swings smoothly, there are various kinds of rotating pieces 11, and the rotating piece 11 arranged on the moving piece 9 is a bearing.

Figure 2:
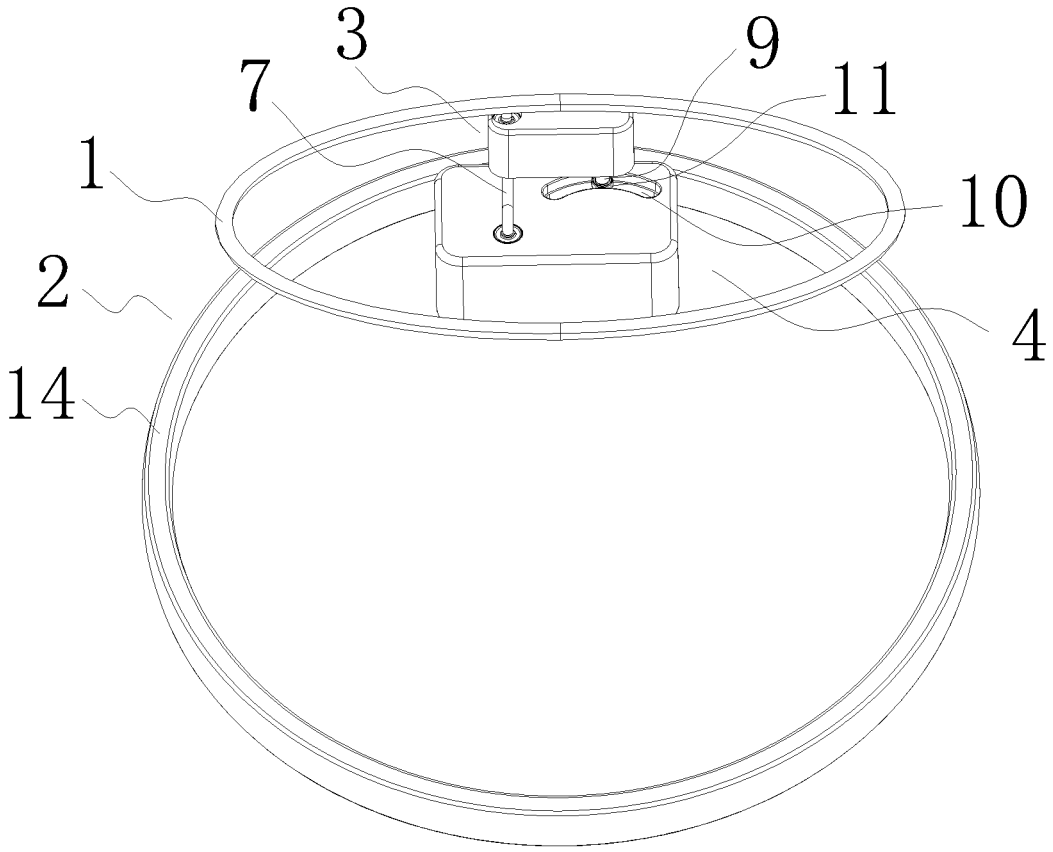
FIG. 2 is a structural schematic diagram of the rocking chair for children swinging from the starting point.
Figure 3:
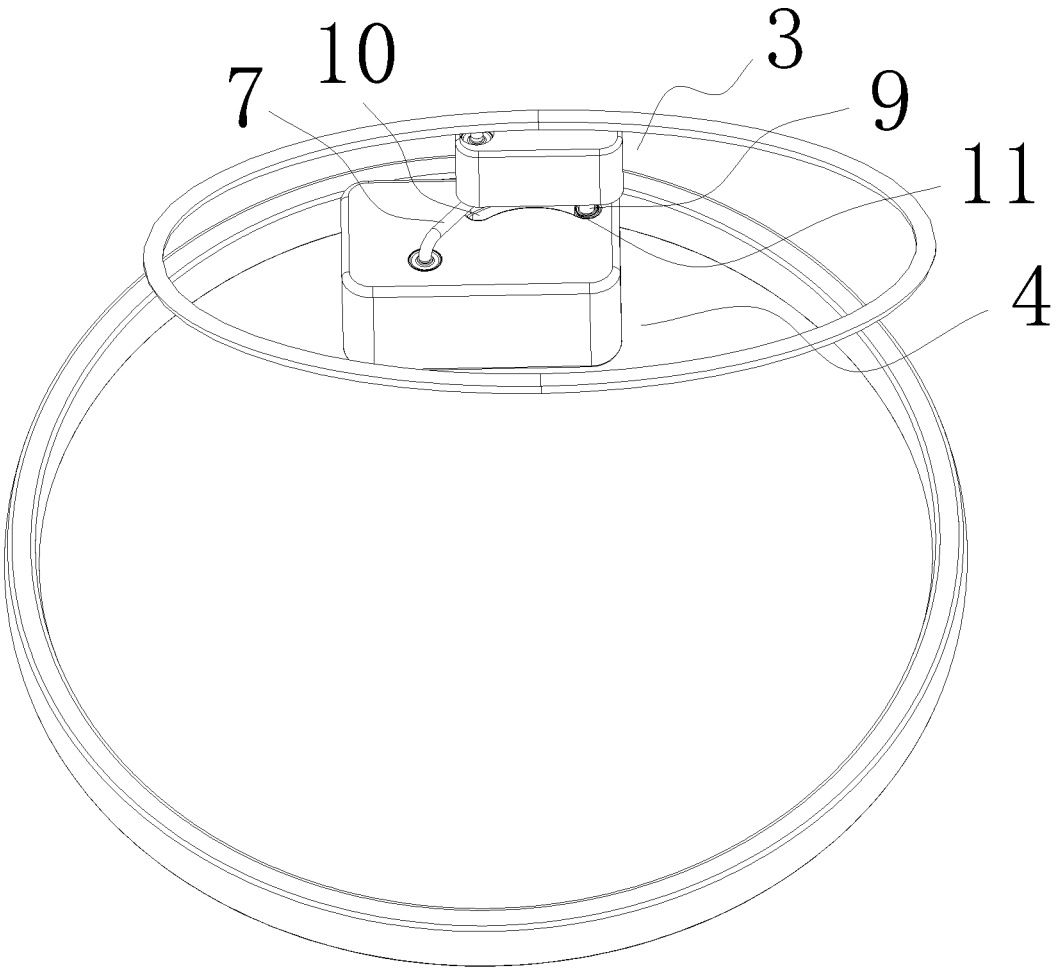
FIG. 3 is a structural schematic diagram of the rocking chair for children swinging to the midpoint.
Figure 9:
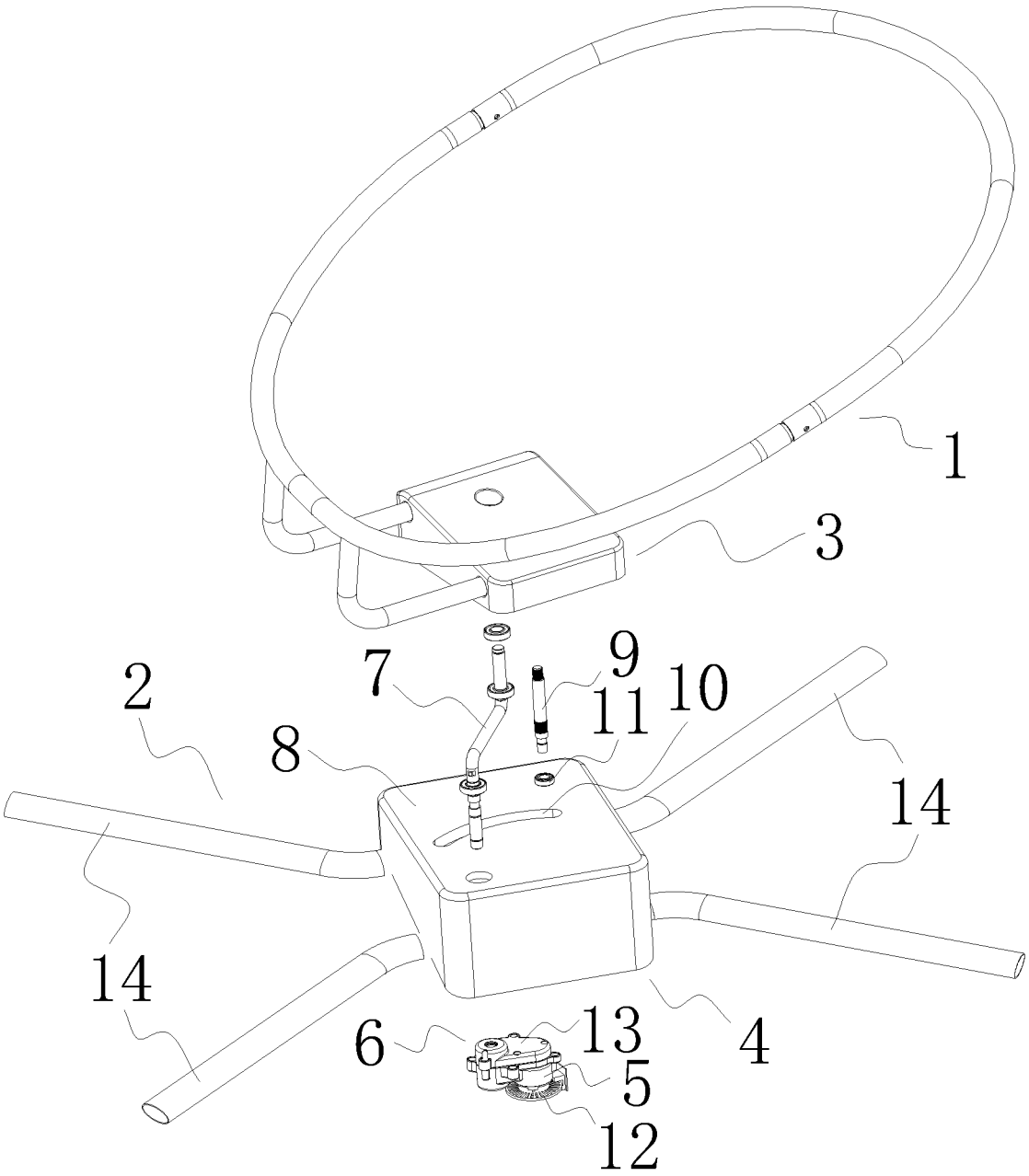
FIG. 9 is an explosion diagram of FIG. 8.
Figure 10:
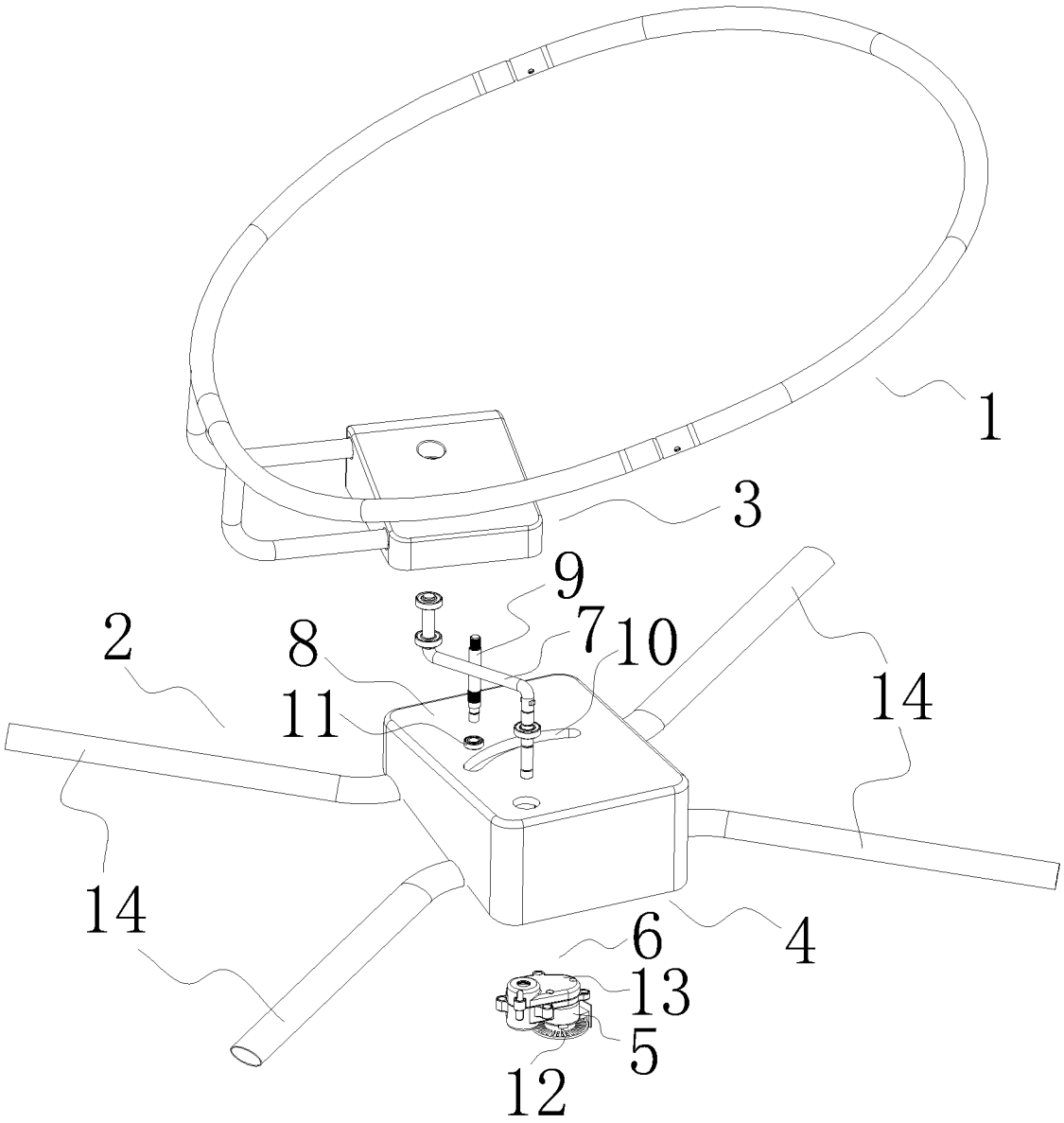
FIG. 10 is an explosion diagram of FIG. 7.

Preferably, the moving groove 10 is an arc-shaped groove, when the rotating shaft 7 rotates from low to high and then to low, the arc-shaped groove is arranged from low to high and then to low, as shown in FIG. 1, when the rotating shaft 7 is at the low position, the moving piece 9 of the moving groove 10 is also at the low position, as shown in FIG. 2, when the rotating shaft 7 rotates to the high position, the moving piece 9 is also at the high position of the moving groove 10, as shown in FIG. 3, when the rotating shaft 7 is at the low position, the moving piece 9 of the moving groove 10 is also at the low position, as shown in FIG. 1, FIG. 2 and FIG. 3, the rotating shaft 7 moves from the starting point to the end point from the low position to the high position and then to the low position, and the moving piece 9 moves from the low position to the high position and then to the low position. The moving groove 10 as shown in FIG. 1, FIG. 2 and FIG. 3 is an arc-shaped groove. When the rotating shaft 7 rotates, the seat body 1 does not have angle change relative to the supporting frame 2 along with the swinging of the rotating shaft 7 and only has distance movement swinging relative to the supporting frame 2, the moving groove 10 as shown in FIG. 9 and FIG. 10 is an arc-shaped groove, and a preferable solution as shown in FIG. 10 has the advantage that the moving groove 10 becomes flatter and is close to a straight line, so that the rotating shaft 7 is smoother. From FIG. 7 to FIG. 10, the seat body 1 not only swings back and forth in a distance moving mode relative to the supporting frame 2, but also swings left and right in an angle changing mode relative to the supporting frame 2, so that two different swing modes can be realized at the same time, the characteristics of low cost and good function are realized, and the moving groove 10 has various shapes, and any shape belongs to the protection range of the invention.

The motion track line of the moving piece 9 moving from the starting point to the end point of the moving groove 10 is an arc, a vertical line connecting a highest point of the arc with a line connecting two end points of the arc is shorter than a vertical line connecting a highest point of another arc, formed by a rotating shaft 7 swinging from a starting point to an end point, with a line connecting two end points of the arc mentioned in latter, and the moving groove 10 is an arc-shaped groove. As a preferred implementation mode, the moving groove 10 is an arc-shaped groove as shown in FIG. 9 and FIG. 10, and FIG. 10 shows a preferred solution which has the advantages that the radian of the arc line of the moving groove 10 is reduced, so that the rotating shaft 7 is smoother, and FIG. 7 to FIG. 10 indicate that the seat body 1 swings back and forth in a distance moving mode relative to the supporting frame 2 and swings left and right in an angle changing mode relative to the supporting frame 2; therefore, two different swing modes can be achieved at the same time, the advantages of being low in achieving cost and good in function are achieved, the moving groove 10 has various shapes, and any shape belongs to the protection range of the invention.

The motion track line of the moving piece 9 moving from a starting point to an end point of the moving groove 10 is an arc; a vertical line connecting a highest point of the arc with a line connecting two end points of the arc is equal to a vertical line connecting a highest point of another arc, formed by a rotating shaft swinging from a starting point to an end point, with a line connecting two end points of the arc mentioned in latter; and the moving groove 10 is an arc-shaped groove. In another implementation mode, as shown in FIG. 1, the moving piece 9 of the moving groove 10 is also low when the rotating shaft 7 is at a low position, as shown in FIG. 2, the moving piece 9 is also high in the moving groove 10 when the rotating shaft 7 is rotated to a high position, as shown in FIG. 3, the moving piece 9 of the moving groove 10 is also low when the rotating shaft 7 is at a low position, FIG. 1, FIG. 2, and FIG. 3 refer to the motion process of the rotating shaft 7 from the starting point to the end point from the low position to the high position and then to the low position, and also refer to the motion process of the moving piece 9 from the low position to the high position and then to the low position. When the rotating shaft 7 rotates, the seat body 1 does not have angle change relative to the supporting frame 2 along with the swinging of the rotating shaft 7 and only has distance moving swinging relative to the supporting frame 2, the moving groove 10 can be in various shapes such as a wave-shaped groove in the FIG. 12 and a U-shaped groove or a V-shaped groove, and the protection range of the device is not affected no matter which shape is.

Figure 14:
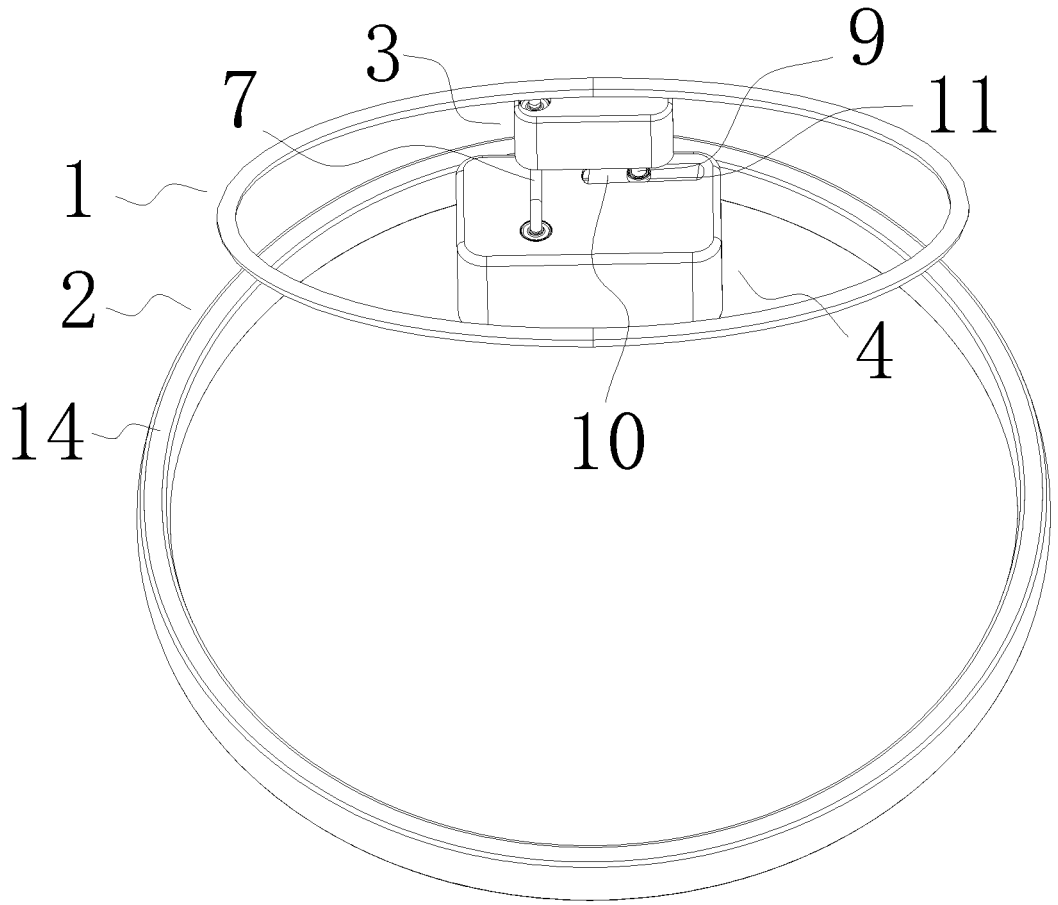
FIG. 14 is a structural schematic diagram of the linear groove of the rocking chair for children.

Another implementation mode is shown in FIG. 14, when the rotating shaft 7 swings from the starting point to the end point, a motion track line formed by the moving piece 9 moving from the starting point to the end point of the moving groove 10 is a straight line, and the moving groove 10 is a linear groove, this is another implementation mode, when the moving groove 10 is a linear groove, the angle generated by the seat body 1 relative to the supporting frame 2 is large.

As shown in the FIG. 1, the matching point of the moving piece 9 and the moving groove 10 and the moving groove 10 are distributed on one side of the rotating shaft 7, so that the seat body 1 is prevented from rotating around the rotating shaft 7.

As shown in FIG. 1, a connecting line from a connecting point between the moving piece 9 and the seat body 1 to a pivot point between the seat body 1 and the rotating shaft 7 is perpendicular to a vertical line from the ground to the pivot point between the seat body 1 and the rotating shaft 7; a connecting line from the connecting point between the moving piece 9 and the seat body 1 to the pivot point between the seat body 1 and the rotating shaft 7 is perpendicular to a connecting line from a matching point between the moving piece 9 and the moving groove 10 to the connecting point between the moving piece 9 and the seat body 1; only in the state, the effect of limiting the seat body 1 to rotate around the rotating shaft 7 is the best.

Figure 5:
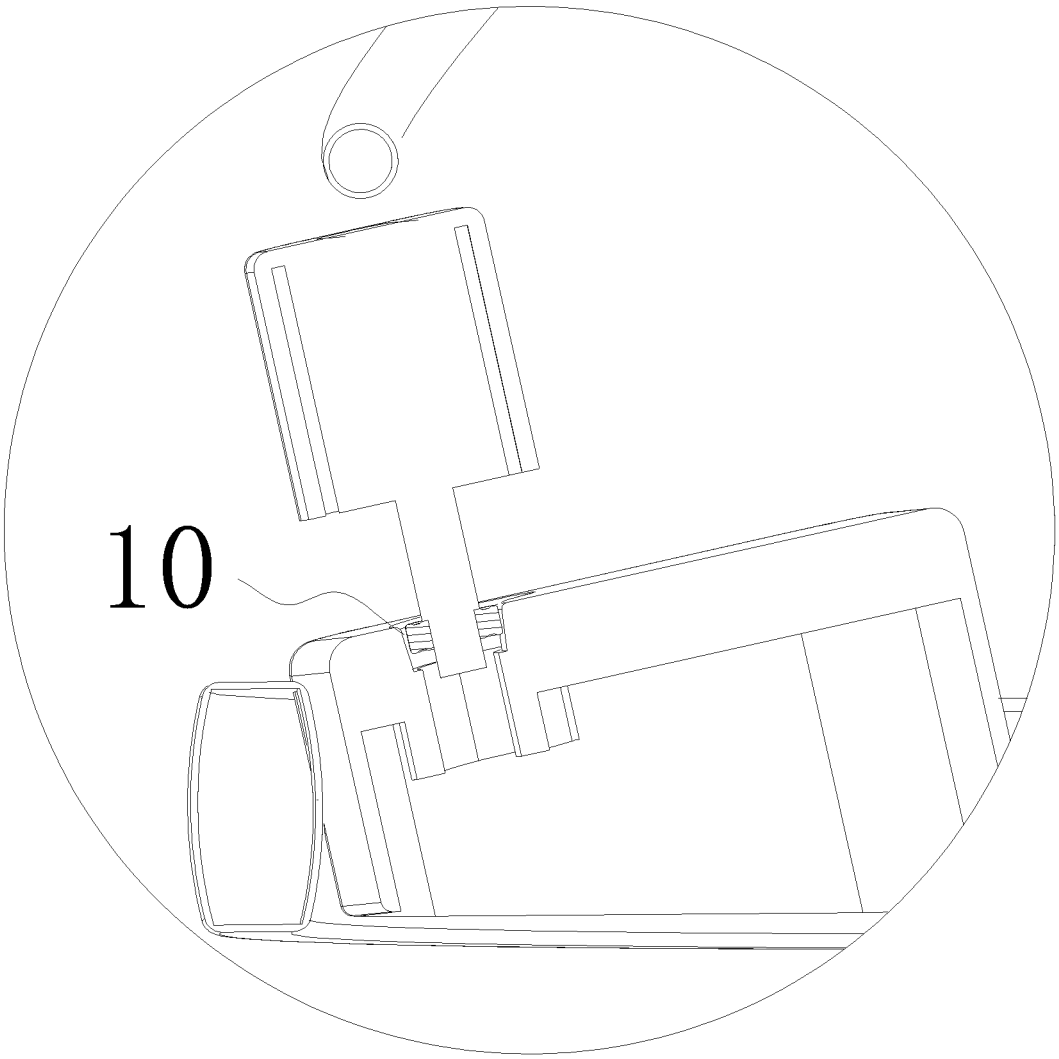
FIG. 5 is a sectional diagram of the moving groove of the rocking chair for children.

As shown in FIG. 5, when the seat body 1 moves left and right, the moving groove is an inclined-plane groove, and the inclined-plane groove obliquely faces the rear direction of the seat body 1. The inclined-plane groove is obliquely arranged towards the rear direction of the seat body 1 so as to prevent the seat body 1 from inclining backwards after a child sits on the seat body 1, and after the seat body 1 inclines backwards, the limiting piece 9 is clamped with the rotating piece 11 on the limiting piece 9. The inclined-plane groove obliquely faces the rear direction of the seat body 1 so that the seat body 1 can move or swing smoothly.

Figure 6:
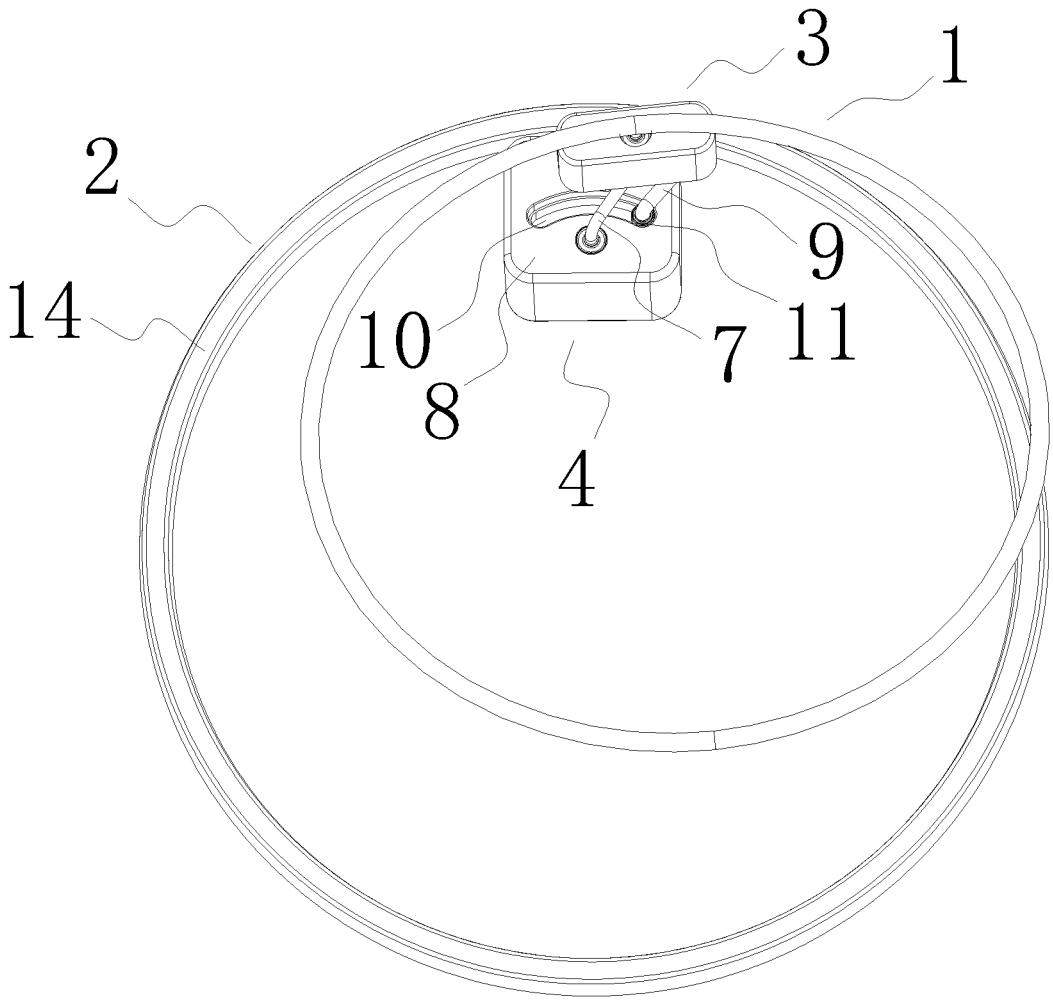
FIG. 6 is a structural schematic diagram of the rocking chair for children that the moving groove is close to the pivot point of the rotating shaft and the mounting box.
Figure 7:
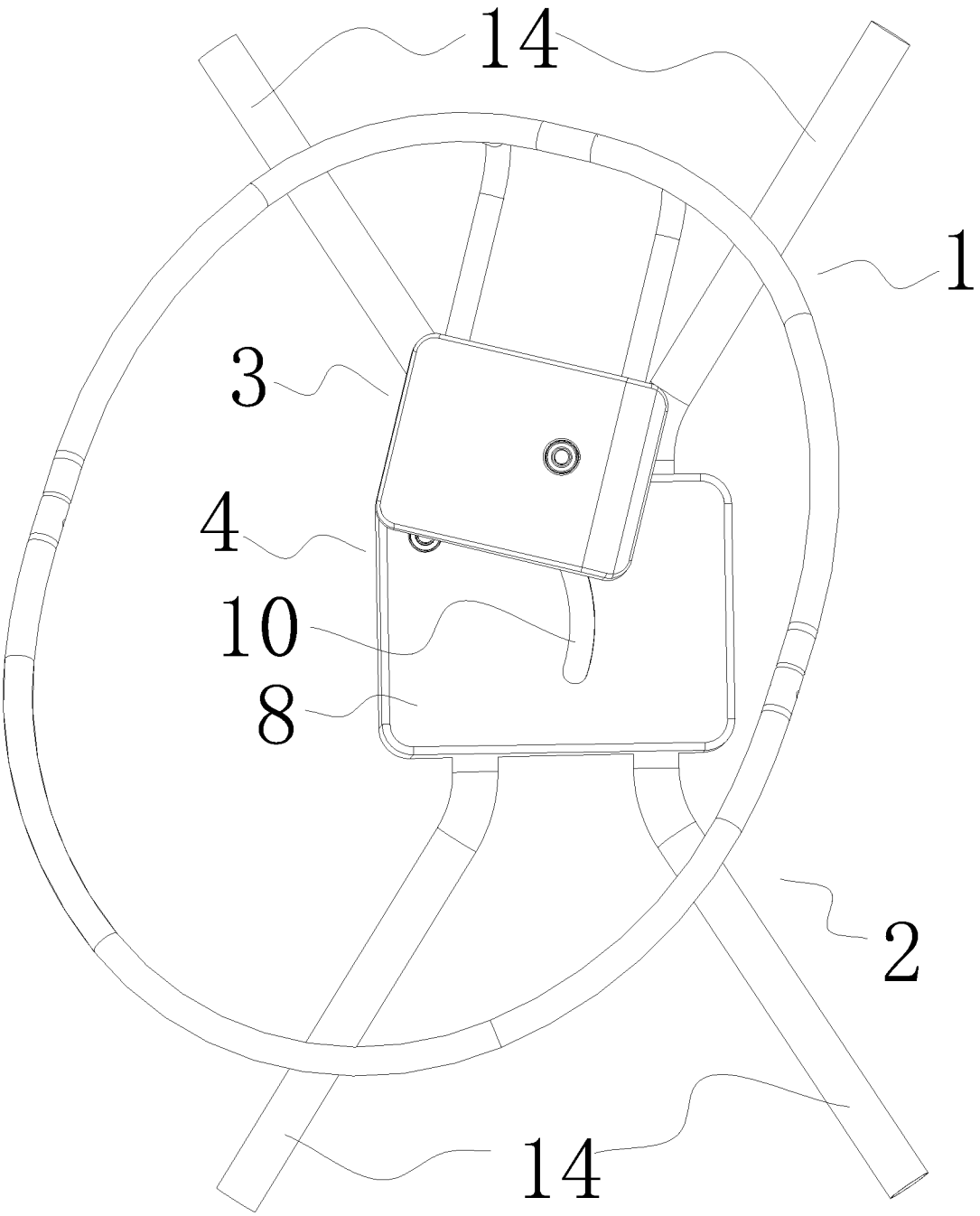
FIG. 7 is a structural schematic diagram that the seat body of the rocking chair for children swings to the left direction.
Figure 8:
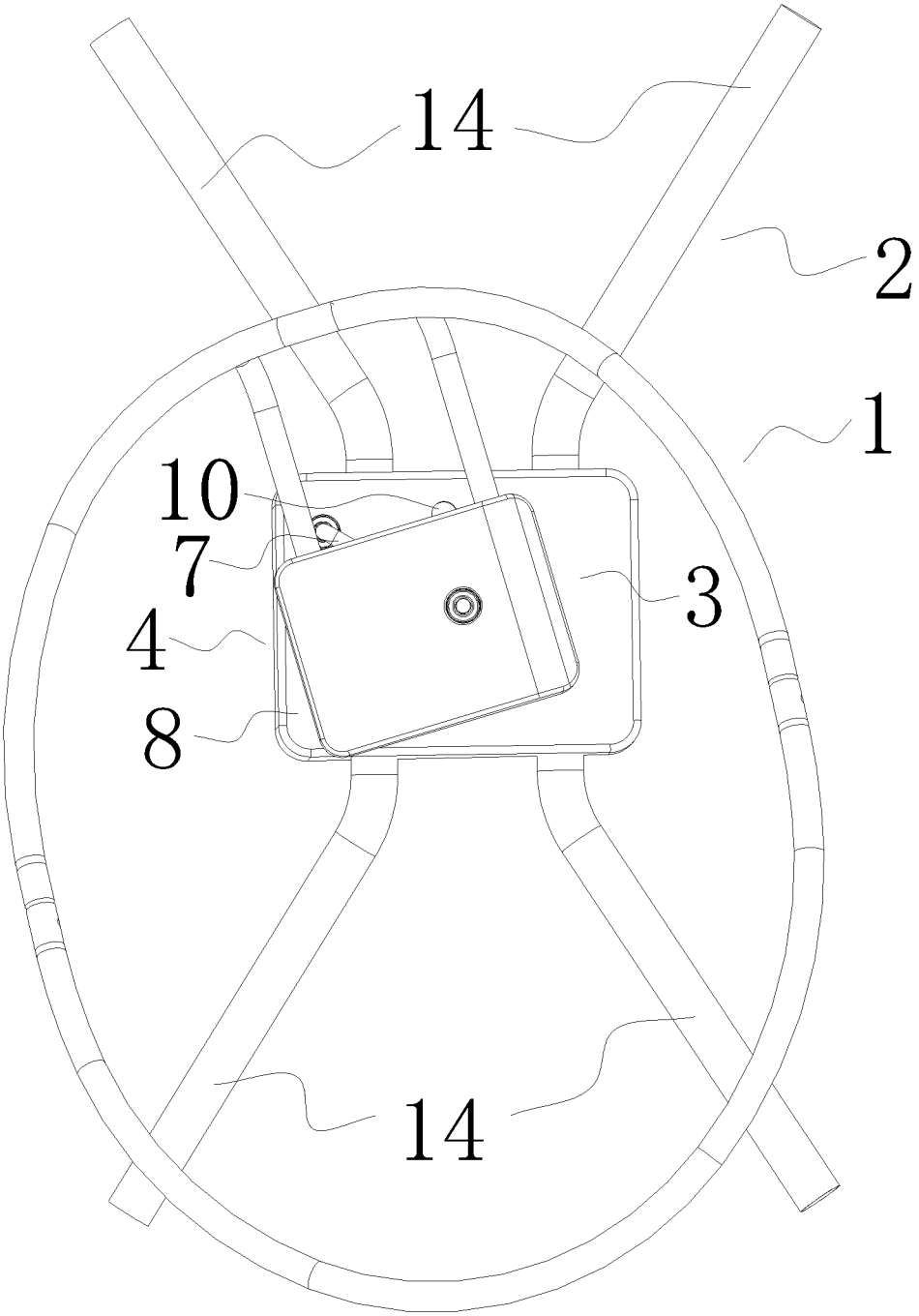
FIG. 8 is a structure schematic diagram that the seat body of the rocking chair for children swings to the right direction.

As shown in the FIG. 6, the moving groove 10 is roughly and symmetrically arranged on the two sides of the projection line, on the mounting box 8, of the rotating shaft 7 when the rotating shaft 7 rotates to the highest position, so that the layout of the moving groove 10 on the mounting box 8 is reasonable, and the size of the mounting box 8 is reduced.

The moving groove 10 is arranged close to the pivot point of the rotating shaft 7 and the mounting box 8. Through the arrangement, the size of the mounting box 8 is reduced, and the appearance of the mounting box 8 is more attractive.

The driving mechanism 4 further includes a sensor 12 arranged on the driving motor 5 and further includes a reduction gear set 13 connected to the driving motor 5, and the sensor 12 can control the driving motor 5 to continuously rotate forwards and backwards in a reciprocating mode, so that the rotating shaft 7 continuously rotates forwards and backwards in a reciprocating mode. The rotating angle of the rotating shaft 7 and positive and negative rotation of the driving motor 5 are detected through the sensor 12, the moving distance of the seat body 1 is controlled, speed reduction and force increasing are achieved through the reduction gear set 13, the structure is simple, and cost is low. The rotating shaft 7 is obliquely arranged on the mounting box 8, the cost can be reduced through the arrangement of the driving mechanism 4, the rotating shaft 7 is obliquely arranged on the mounting box 8 and is pivoted with the seat body 1, so that the seat body 1 generates conversion of kinetic energy and potential energy, and the aim of saving labor is achieved.

Figure 13:
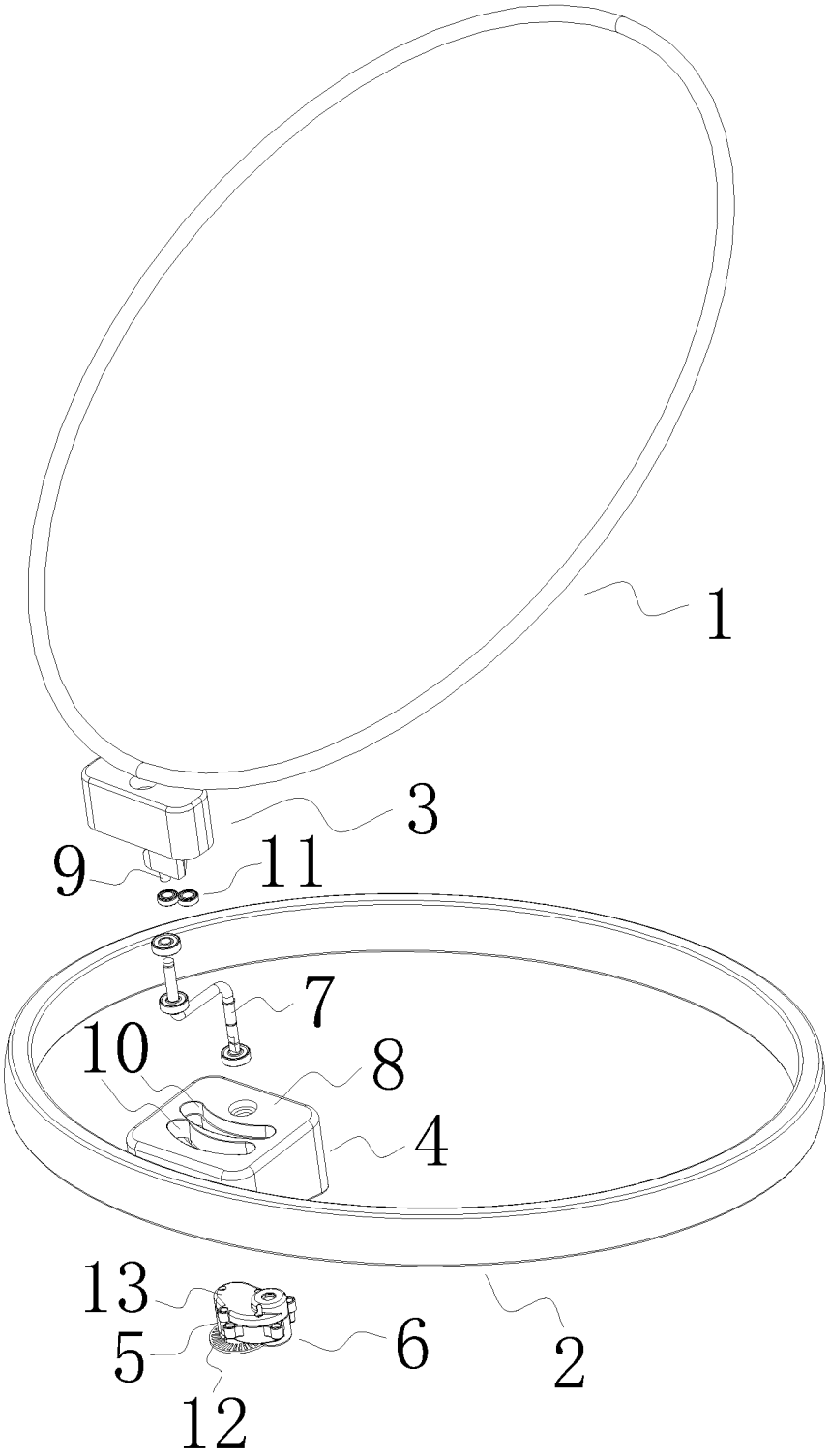
FIG. 13 is a structural schematic diagram that the rocking chair for children is provided with two rotating pieces.

As shown in the FIG. 13, two rotating pieces 11 are arranged on the moving piece 9, two moving grooves 10 correspondingly matched with the two rotating pieces 11 are formed in the mounting box 8, and the two rotating pieces 11 are arranged to prevent the moving piece 9 from rotating around the rotating shaft 7 along with the seat body 1 when the moving piece 9 moves relative to the moving grooves 10.

The rocking chair for children has the advantages that the swing range is large, the cost is low, the seat body 1 is stable, the structure is simple, meanwhile, two different swing modes can be set, and the defects that the swing range is small, the process requirement is high, and only one swinging function can be achieved in the market are overcome. The rocking chair is simple in structure and low in cost, the seat body 1 is stable, two different swing modes can be realized at the same time, and the rocking chair is invented through long-term elaborate research of engineers, is not easily thought by those skilled in the field and is not common knowledge of the public. One end and the other end described in the invention are only used to describe the name of the thing, which can be understood as the top of the thing or a section of the thing.

Although the invention has been described above with reference to embodiments, various improvements can be made without departing from the scope of the invention, and the invention can be implemented in other ways equivalent or well-known to those skilled in the art. In particular, as long as there is no structural conflict, the features in the embodiments disclosed in the invention can be combined with each other in any way. The description does not describe these combinations exhaustively, just for the sake of omitting space and saving resources. Therefore, the invention is not limited to the specific embodiments disclosed herein, but includes all technical solutions falling within the scope of the claims.

The invention claimed is:

1. A rocking chair for children, comprising a seat body, a supporting frame and a seat body limiting mechanism, wherein the supporting frame comprises a driving mechanism, the driving mechanism comprises a driving motor, a driving motor power output part and a rotating shaft, the seat body is used for carrying a child, there is only one rotating shaft providing a sole support for the seat body, one end of the rotating shaft pivots at the supporting frame and is fixedly connected with the driving power output part, another end of the rotating shaft pivots at the seat body, and a vertical line from ground to a pivot point between the rotating shaft and the supporting frame deviates from a vertical line from the ground to a pivot point between the rotating shaft and the seat body; the seat body limiting mechanism comprises a limiting piece and a limiting matching piece matched with the limiting piece, the limiting piece is movably connected with the limiting matching piece, when the rotating shaft rotates, the rotating shaft is rotated relative to the seat body, and the seat body limiting mechanism limits an included angle between the seat body and the rotating shaft to be kept at pre-set angles.

2. The rocking chair for children according to claim 1, characterized in that the limiting piece and the limiting matching piece are movably connected in a relative distance moving mode, and when the rotating shaft rotates, the limiting piece and the limiting matching piece move relatively at a certain distance so as to limit the included angle between the seat body and the rotating shaft to be kept at pre-set angles.

3. The rocking chair for children according to claim 2, characterized in that the limiting piece is connected with the seat body, and the limiting matching piece is arranged on the supporting frame.

4. The rocking chair for children according to claim 3, characterized in that a vertical line from the ground to a connecting point between the limiting piece and the seat body deviates from a vertical line from the ground to a pivot point between another end of the rotating shaft and the seat body.

5. The rocking chair for children according to claim 4, characterized in that the supporting frame comprises a base and a mounting box, the mounting box is connected with the base, the limiting piece is a moving piece, the limiting matching piece is a moving groove, when the rotating shaft rotates, the moving piece moves relative to the moving groove, the moving piece is arranged on the seat body, the moving groove matched with the moving piece is formed in the mounting box, and when the rotating shaft rotates, the limiting piece moves relative to the limiting matching piece at a certain distance along with the seat body.

6. The rocking chair for children according to claim 5, characterized in that a rotating piece is arranged on the moving piece, the rotating piece is able to rotate around the moving piece, and the rotating piece is in surface fit with the moving groove.

7. The rocking chair for children according to claim 6, characterized in that a motion track line of the moving piece moving from a starting point to an end point of the moving groove is an arc; a vertical line connecting a highest point of the arc with a line connecting two end points of the arc is shorter than a vertical line connecting a highest point of another arc, formed by a rotating shaft swinging from a starting point to an end point, with a line connecting two end points of the arc mentioned in latter; and the moving groove is an arc-shaped groove.

8. The rocking chair for children according to claim 6, characterized in that a motion track line of the moving piece moving from a starting point to an end point of the moving groove is an arc; a vertical line connecting a highest point of the arc with a line connecting two end points of the arc is equal to a vertical line connecting a highest point of another arc, formed by a rotating shaft swinging from a starting point to an end point, with a line connecting two end points of the arc mentioned in latter; and the moving groove is an arc-shaped groove.

9. The rocking chair for children according to claim 8, characterized in that the moving groove is an inclined-plane groove, and the inclined-plane groove obliquely faces a rear direction of the seat body.

10. The rocking chair for children according to claim 6, characterized in that when the rotating shaft swings from a starting point to the end point, a motion track line formed when the moving piece moves from the starting point to an end point of the moving groove is a straight line, and the moving groove is a linear groove.

11. The rocking chair for children according to claim 6, characterized in that a matching point of the moving piece and the moving groove and the moving groove are distributed on one side of the rotating shaft.

12. The rocking chair for children according to claim 11, characterized in that a connecting line from a connecting point between the moving piece and the seat body to a pivot point between the seat body and the rotating shaft is perpendicular to a vertical line from the ground to the pivot point between the seat body and the rotating shaft; the connecting line from the connecting point between the moving piece and the seat body to the pivot point between the seat body and the rotating shaft is perpendicular to a connecting line from a matching point between the moving piece and the moving groove to the connecting point between the moving piece and the seat body.

13. The rocking chair for children according to claim 6, characterized in that the moving groove is an arc-shaped groove or an irregular wavy groove with alternating heights, and the moving groove is roughly and symmetrically formed in two sides of a projection line, on the mounting box, of the rotating shaft when the rotating shaft rotates to a highest position.

14. The rocking chair for children according to claim 13, characterized in that the moving groove is arranged close to a pivot point between the rotating shaft and the mounting box.

15. The rocking chair for children according to claim 14, characterized in that two rotating pieces are arranged on the moving piece, and two moving grooves correspondingly matched with the two rotating pieces are formed in the mounting box.

16. The rocking chair for children according to claim 1, characterized in that the driving mechanism further comprises a sensor arranged on the driving motor and a reduction gear set connected to the driving motor, and the sensor is able to control the driving motor to continuously rotate forwards and backwards in a reciprocating mode so that the rotating shaft is able to continuously rotate forwards and backwards in a reciprocating mode, and the rotating shaft is obliquely arranged on a mounting box.

* * * * *